United States Patent [19]

Weaver

[11] 4,046,253

[45] Sept. 6, 1977

[54] SHIRT PACKAGE

[75] Inventor: Mark Weaver, Pottsville, Pa.

[73] Assignee: Phillips-Van Heusen Corporation, New York, N.Y.

[21] Appl. No.: 617,099

[22] Filed: Sept. 26, 1975

[51] Int. Cl.[2] ..... B65D 85/18

[52] U.S. Cl. ..... 206/278; 53/26

[58] Field of Search ..... 206/278, 282, 292; 53/26, 35

[56] References Cited

U.S. PATENT DOCUMENTS

| | | | |
|---|---|---|---|
| 1,862,353 | 6/1932 | Allison | 206/278 |
| 1,971,107 | 8/1934 | Jones | 206/278 |
| 1,994,382 | 3/1935 | Berger | 206/278 |
| 2,684,188 | 7/1954 | Sturz | 206/278 |
| 2,764,280 | 9/1956 | Carper | 206/278 |
| 3,099,353 | 7/1963 | Berry | 206/278 |
| 3,256,976 | 6/1966 | Greason | 206/278 |
| 3,511,364 | 5/1970 | Airdo | 206/278 |
| 3,870,150 | 3/1975 | Hummel | 206/278 |
| D. 153,556 | 4/1949 | Russell | 206/278 |

*Primary Examiner*—William Price
*Assistant Examiner*—Joseph Man-Fu Moy
*Attorney, Agent, or Firm*—Eric Y. Munson

[57] ABSTRACT

An improved shirt package; shirt package envelope; and method of forming a shirt package in which the shirt package comprises a shirt wrapped around the conventional flat rectangular shirt board formed of cardboard or the like with the body and sleeves of the shirt folded about the shirt board, and the collar portion of the shirt arranged in a position upstanding from one end of the shirt board and generally supported in its upstanding configuration by a collar support board of cardboard or the like. The rectangular relatively rigid shirt board supported folded shirt is inserted into a transparent envelope of polyethylene or the like, with the envelope according to the invention formed with a relatively larger volumetric capacity at the relatively bulkier collar supporting portion of the shirt wrapped shirt board, and a relatively smaller volumetric capacity at the shirt body supporting portion of the shirt wrapped shirt board, so that the envelope snugly engages the shirt wrapped shirt board.

6 Claims, 5 Drawing Figures

SHIRT PACKAGE

BACKGROUND OF THE INVENTION

This invention relates to the art of shirt packaging and more particularly to so-called polybag shirt packages in which a shirt supported on a rectangular shirt cardboard or the like is inserted into a transparent envelope.

So-called polybag shirt packages have been evolved in which a shirt is folded about a shirt board, or the like, of a rectangular configuration, and the collar portion of the shirt is supported in a plane upstanding from the plane of the shirt board by means of a collar board inserted between the neck band and the collar flap of the shirt. The shirt board supported shirt is then conventionally inserted into a rectangular transparent bag or envelope of polyethylene or the like to provide the conventional polybag shirt package.

It has been found in the utilization of these rectangular shirt packages that the conventionally employed polyethylene bag or envelope of a rectangular configuration must be made sufficiently wide to provide the necessary internal volume to accommodate the upstanding collar portion of the shirt. As a result of this increased width at the collar, the conventional rectangular polyethylene envelope has an undesired clearance between the interior of the envelope and the lower portions of the shirt wrapped shirt board at the portion of the package remote from the collar. Aside from the cost entailed in providing the necessary unused material for the polybag, the extra unused volume of the flexible bag is subject to being snagged and torn, and provides an unsightly flap of unused material at the lower part of the bag or envelope.

Additionally, with rough handling, it is found that the shirt wrapped shirt board often slips out of the envelope.

BRIEF DESCRIPTION OF THE INVENTION

It is with the above problems and considerations in mind, that the present improved shirt package; shirt package envelope; and method of forming the improved shirt package has been evolved in which undesired slack present in conventional polybag shirt packages is eliminated; and the conventional shirt wrapped rectangular flexible shirt board is retained with minimal likelihood of slippage from the package envelope; and the quantity of material conventionally required in the production of polybags for use in shirt packaging has been minimized.

It is accordingly among the primary objects of this invention to provide an improved shirt package in which a shirt is supported in a clear transparent bag for shipment and display.

A further object of the invention is to provide an improved transparent bag shirt package in which the transparent bag or envelope does not have any undesired slack, subject to wrinkling and undesired snagging resulting in tearing of the shirt envelope.

A further object of the invention is to provide an improved transparent envelope encased shirt package in which the conventional bagging material normally employed is reduced.

It is also an object of the invention to provide an improved method for packaging shirts, minimizing undesired slack in the package envelope.

Another object of the invention is to provide an improved envelope for shirt packages minimizing undesired slippage of the shirt wrapped shirt board from the envelope.

These and other objects of the invention which will become hereafter apparent are achieved by providing a shirt package in which a shirt is, as conventionally, folded about a rectangular shirt board of cardboard or the like sheet material, with the shirt body and shirt sleeves folded over the edges of the shirt board, and the collar arranged in upstanding fashion at one end of the rectangular shirt board (generally supported by a collar board arranged between the collar band and collar). The resultant rectangular board supported shirt is then inserted into a transparent flexible bag or envelope of polyethylene, or the like. In accordance with the invention, the envelope is formed with a narrow base of a length to provide a free slip fit between the edge of the cardboard supported shirt remote from the collar and the envelope; and a wider base having a dimension to provide a volume accommodating the collar end of the board supported shirt. Insertion of the relatively bulky collar bearing portion of the shirt wrapped board into the opening at the relatively narrow end of the opening is accomplished by bending the shirt wrapped shirt board about a longitudinal axis as it is inserted.

A feature of the invention resides in the fact that by forming the transparent shirt bag of a trapezoidal configuration, with a narrow end and wide end, the previously encountered slack at the non-collar portion of the board supported shirt is eliminated, thus improving the appearance of the package, and eliminating any undesired package slack which is subject to snagging and tearing during shipment.

An additional feature of the invention resides in the fact that the reduced width of the bag as compared to conventional transparent packaging bags at the non-collar portion of the board supported shirt permits a saving in bag material.

A further feature of the invention resides in the formation of the envelope opening at the narrow end of the bag with the shirt wrapped board flattened in the envelope after insertion to permit the increased volume to lock the shirt in the envelope.

BRIEF DESCRIPTION OF THE DRAWINGS

The specific details of the invention and their mode of functioning, and the best mode presently contemplated for carrying out the invention so as to enable those skilled in the art to make and use same, will be described in clear, concise and exact terms in conjunction with the accompanying drawings wherein.

DESCRIPTION OF THE PREFERRED EMBODIMENT

Referring now more particularly to the drawings, like numerals of the various FIGS. will be employed to designate like parts.

Figure 1:
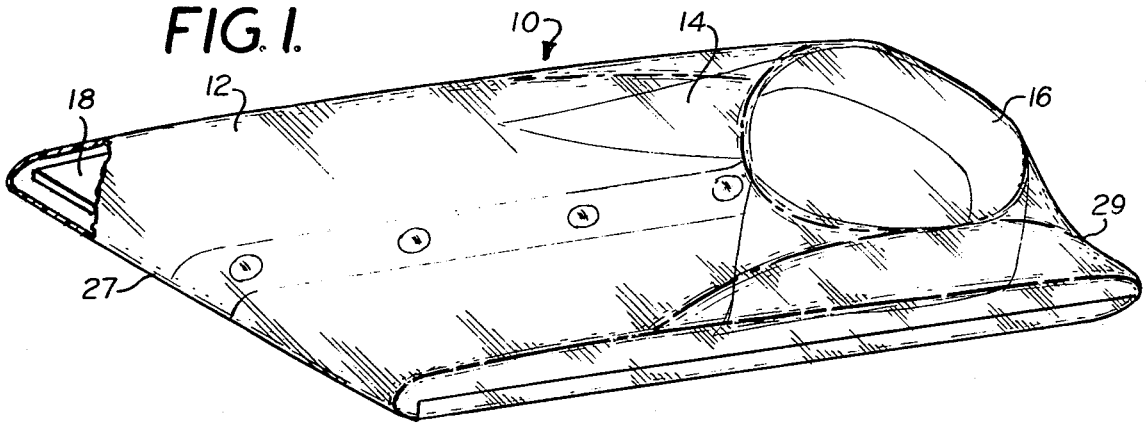
FIG. 1 is a perspective view of a shirt package made in accordance with the teachings of the invention with parts broken away to show the shirt supporting shirt board.
Figure 2:
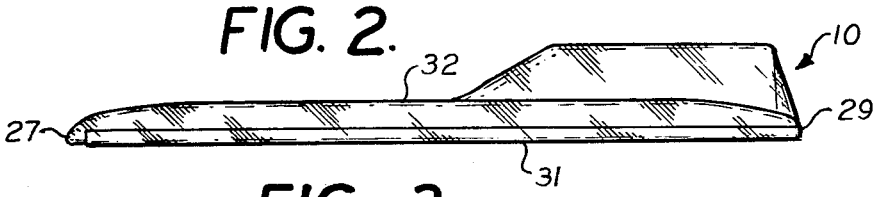
FIG. 2 is a reduced side elevational view of the shirt package shown in FIG. 1, illustrating how the volume occupied by the collar portion of the packaged shirt is accommodated by the envelope package.

The shirt package 10, as illustratively shown, is formed by wrapping a shirt 12 having a collar 14 with a neck band 15 on a shirt board 18 (shown in the broken away portion at the upper left in FIG. 1).

The shirt board 18 is of a conventional rectangular configuration, and may be formed as conventionally of cardboard or the like relatively stiff sheet material.

Figure 5:
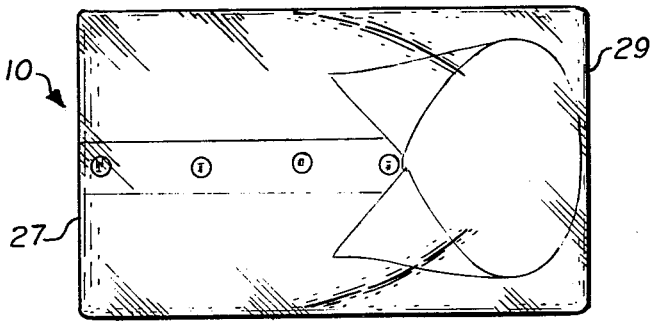
FIG. 5 is a reduced top plan view of the shirt package shown in FIG. 1.

The shirt 12 is wrapped around the shirt board as conventionally, as illustrated in FIGS. 1 and 5, with the shirt front placket arranged on a top face of the board, with the collar 14 of the shirt positioned at one end of the shirt board 18, and arranged with the collar band 16 upstanding from the shirt board. A collar supporting board may, if desired, as conventionally, be arranged between the collar and collar band to support the collar band in the desired upstanding position. As understood by those skilled in the art, the collar board may be formed integrally with the shirt board.

Figure 3:
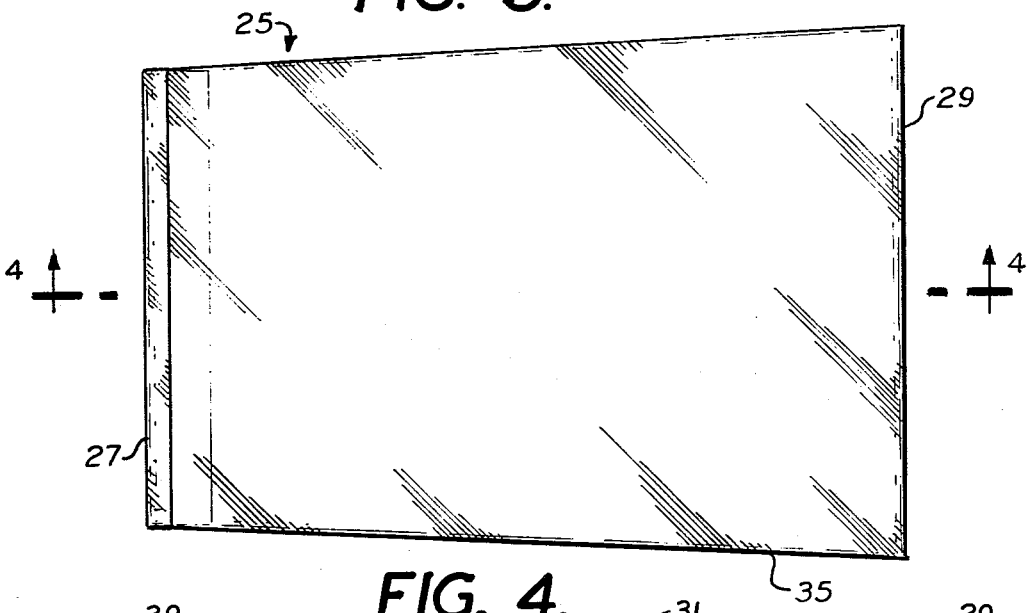
FIG. 3 is a plan view of an envelope employed in forming the shirt package of FIG. 1, looking down at the face of the envelope underlying the back of the shirt package.
Figure 4:
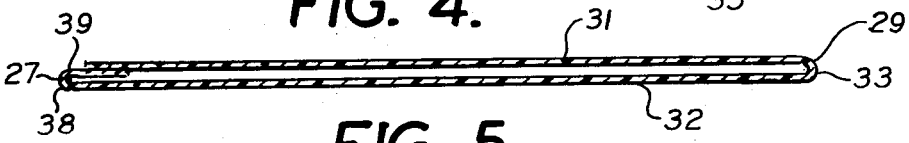
FIG. 4 is a cross-sectional view taken on line 4—4 of FIG. 3.

In accordance with the invention, an envelope 25, as best seen in FIGS. 3 and 4, is provided for receiving the shirt wrapped board. It is preferred that the envelope be made of a transparent sheet material so as to permit ready viewing of the shirt. A variety of transparent sheet materials, such as polyethylene, or the like wide variety of materials conventionally employed for forming shirt bags or envelopes, is employed. The envelope 25, as best seen in FIG. 3, is preferably formed of a trapezoidal configuration in plan view. As illustrated, the envelope 25 is formed with a relatively narrow base 27, and a relatively wide base 29. Narrow base 27 is of a length slightly larger than the width of the shirt board 18 to be received in the envelope, the length of narrow base 27 being such as to slidingly accommodate the shirt board 18 with the shirt 12 wrapped thereabout. In practice, the narrow base is preferably formed of a dimension equal to the width of the shirt wrapped shirt board, plus between $\frac{1}{4}$–2, depending on the thickness of the shirt material. It will be understood by those skilled in the art, that the term "slightly larger" is here employed to define a difference between the width of the shirt cardboard 18, and the envelope such as to provide a clearance between the envelope and the shirt wrapped shirt board to provide a smooth relatively snug enclosure of the shirt wrapped shirt board in the envelope 25.

A relatively wide base 29 is formed on the shirt envelope 25, with the length of this wide base 29 being slightly larger than the width of the shirt cardboard 18 plus the height of the shirt collar 16 upstanding from the shirt board. The length of this wide base 29 is such that when the shirt wrapped cardboard is inserted into the envelope 25, the increased volume occupied by the collar will be accommodated by the envelope, with the edges of the envelope being drawn up against the shirt wrapped shirt board 18.

The envelope 25, as illustratively shown in FIGS. 3 and 4, is formed as conventionally with two plies: a back ply 31 (the upper ply in FIG. 4); and a front ply 32 (the lower ply in FIG. 4). Plies 31 and 32 are preferably formed from a single strip of sheet material folded over at fold line 33 lying along the large base of the trapezoid shaped envelope, and heat sealed along overlapping longitudinally extending edges 35 and 37. In the illustrated embodiment, a fold line 38 is formed in front ply 32 to provide for a flap 39, adapted to underlie bottom ply 31 with an opening between bottom ply 31 and top ply flap 39, to facilitate insertion of the shirt wrapped shirt board 18 into the envelope.

OPERATION

In use, the package envelope 25 is fabricated by conventional envelope fabricating techniques normally employed in the fabrication of shirt package envelopes formed of thermoplastic sheet materials, such as polyethylene or the like. Strips of polyethylene, preferably in the form of two trapezoidal sections joined along their longer base are folded over about a fold line 33, as viewed in FIG. 4, along the longer base 29, with a flap 37 on one of the trapezoidal sections left exposed, and folded over about fold line 38 beneath one of the plies 31, as viewed in FIG. 4. The overlapping longitudinally extending edges of the folded over sheet are preferably heat sealed along edges 35 and 37, as viewed in FIG. 3, by conventional heat sealing techniques to close off the edges of the folded over plies 31 and 32, with flap 39 adapted to be tucked under ply 31, as viewed in FIG. 4.

The shirt 12 is wrapped in conventional fashion about the conventional rectangular shirt board 18 with the collar portion 16 upstanding from the shirt board in conventional fashion. This shirt wrapped shirt board is then inserted into the envelope which is provided with a wider base portion adjacent the collar. Insertion of the relatively bulkier collar supporting portion of the shirt board into the opening in the narrow end of the envelope is accomplished by bending the shirt wrapped board about a longitudinal axis to contour the board into a conical section and slipping it into the envelope, where, after insertion, it snaps back to its planar configuration, locking into the envelope.

As above described, and as will be understood by those skilled in the art, the increased width of the base portion, as provided by the invention, serves to provide for increased volumetric capacity of the envelope at the collar portion of the envelope. The desired snug fit of the envelope about the shirt wrapped cardboard is provided by virtue of the contouring of the envelope with a wider base portion, and after insertion into the opening at the narrow end of the envelope, the shirt wrapped board is locked into the envelope.

The previously encountered extra material present at the lower portion of the board, such as is conventionally provided by the previously employed rectangular envelope, is eliminated, and the extra unused material is no longer necessary, thus providing material saving.

The above disclosure has been given by way of illustration and elucidation, and not by way of limitation, and it is desired to protect all embodiments of the herein disclosed inventive concept within the scope of the appended claims.

What is claimed is:

1. A shirt package comprising:

a rectangular shirt supporting plane shirt board;

a shirt having a collar with the collar lying over one end of said shirt board and upstanding therefrom;

an envelope receiving said shirt board with the shirt folded thereabout, said envelope having a narrow end slightly larger than the width of the shirt board in which the end of the shirt wrapped board remote from the collar of the shirt is received, and a wide end remote from said narrow end slightly larger than the width of the shirt board plus the height of the shirt collar upstanding from the board such that the collar supporting portion of the shirt board with the collar upstanding therefrom is received in the envelope with the envelope snugly engaging the shirt wrapped shirt board.

2. A shirt package as in claim 1, in which said envelope is of a trapezoidal configuration in plan view with said narrow end being the small base of the trapezoid, and said wide end being the large base of the trapezoid.

3. A shirt package as in claim 1, in which said envelope is formed with an opening at the narrow end thereof.

4. A shirt package as in claim 1, in which said envelope comprises: an elongate transparent thermoplastic sheet material folded over on itself along a transverse line; heat sealed joints between mating longitudinally extending edges of said sheet material; and an open end remote from the line of folding.

5. A method of forming a shirt package in which a shirt is retained for shipment and display, said method comprising the steps of:

providing a rectangular shirt board;

wrapping the shirt to be packaged on said shirt board with the collar of the shirt upstanding from said shirt board at one end thereof;

providing a transparent envelope with a relatively narrow end slightly larger than the width of said shirt wrapped shirt board, and a relatively wide end slightly larger than the width of said shirt wrapped shirt board plus the height of the collar upstanding from the shirt board; and inserting the shirt wrapped shirt board into said envelope with the collar supporting portion of the board received in the wide end of the envelope.

6. A method as in claim 5, in which the envelope is formed with an opening at the narrow end of said envelope; and the shirt wrapped board is inserted into the envelope opening by bending the shirt wrapped board along a longitudinal axis of the shirt board before insertion; introducing the collar supporting portion of the shirt board into the opening; slipping the bent shirt wrapped board fully into the envelope; and releasing the board to permit it to lie flat in the envelope with the collar at the wide end of the envelope.

* * * * *